United States Patent [19]

Herdzina et al.

[11] 4,372,720

[45] Feb. 8, 1983

[54] FORMING OF END CLOSURES

[75] Inventors: Frank J. Herdzina, Schaumburg; Hans Kossmann, Barrington; Harold C. Lemke, Grayslake, all of Ill.

[73] Assignee: American Can Company, Greenwich, Conn.

[21] Appl. No.: 183,977

[22] Filed: Sep. 4, 1980

[51] Int. Cl.[3] ..... B21D 51/44

[52] U.S. Cl. ..... 413/56

[58] Field of Search ..... 413/8, 56

[56] References Cited

U.S. PATENT DOCUMENTS

| | | | |
|---|---|---|---|
| 1,730,575 | 10/1929 | Hothersall | 413/8 |
| 2,213,427 | 9/1940 | Bogner | 413/8 |
| 3,768,295 | 10/1973 | Cudzik | 413/56 |
| 3,957,005 | 5/1976 | Heffner | 413/8 |
| 4,031,837 | 6/1977 | Jordan | 413/8 |

*Primary Examiner*—Joseph H. McGlynn

*Attorney, Agent, or Firm*—Paul R. Audet; Stuart S. Bowie; Aaron Passman

[57] ABSTRACT

A method and apparatus are disclosed and can be used to fabricate a complete container end closure including an inwardly tipped cover hook located along the peripheral extremity. The apparatus and its use in performing the method are unique in that one tool does all the forming to produce the complete end closure. More particularly, the cover hook is preformed by a first tool operation and then finally formed by a subsequent step wherein the preformed end is reformed to a final configuration in a step which is completely independent of the first tool.

8 Claims, 9 Drawing Figures

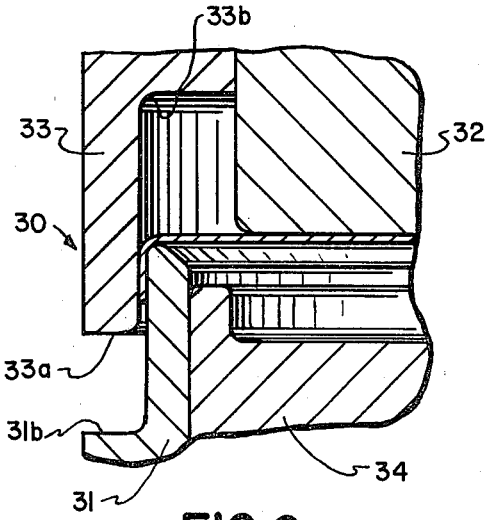
FIG.6
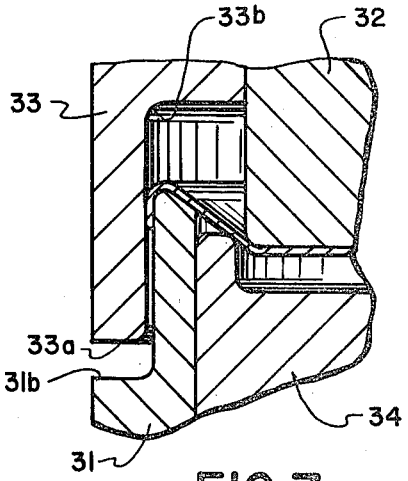
FIG.7
FIG.8
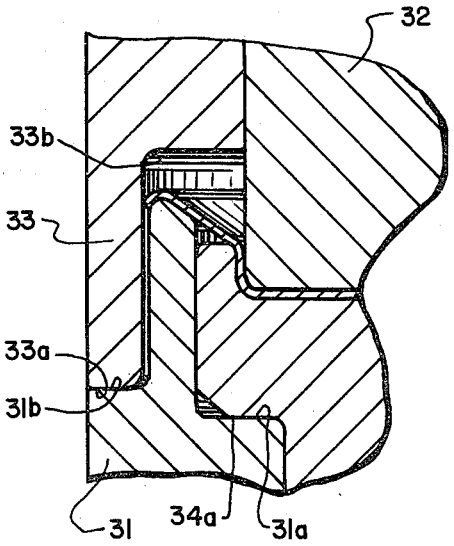
FIG.9
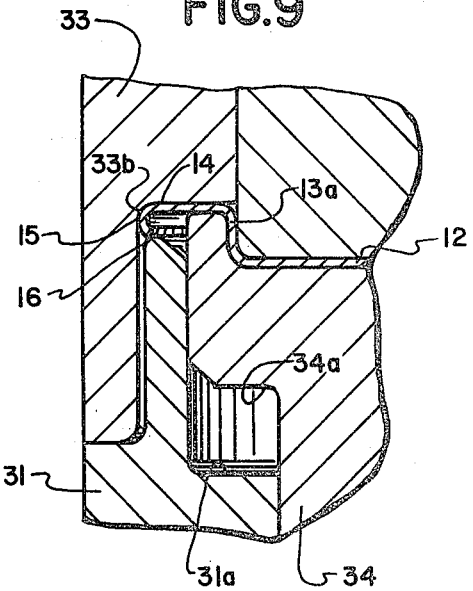

FORMING OF END CLOSURES

BACKGROUND OF THE INVENTION

The present invention relates to improvements in the method and apparatus for forming flanged can ends with curled edges. The improvements are intended for stamping circular or noncircular can ends, the latter being square, oval or the traditional triangular ham can ends being curled along the outer edges whereby they may be secured to a flanged can body by double seaming. Double seaming metal end closures to flanged can bodies, for example, those used for packing comestibles and the like requires an end with a prescribed configuration. More particular standards have been established defining the countersink radius the countersink wall length extending from the countersink to the end closure cover hook and the radial extension and curl configuration of the cover hook. Consequently, a conventional method of double seaming an end closure to an open ended container body includes interfolding the flange of the marginal end portion of the can body during double seaming the body flange with the closure cover hook by rolling or tucking the closure edges under the body flange to form five metallic layers. The pressing or ironing of the five layers tightly together against the upper side body wall of the container hermetically seals the open body end.

Closure ends are generally formed with a countersink groove and wall extending outwardly of the can to a radially disposed cover hook flange. The cover hook flange extends outwardly to the cover hook whereat it curls downwardly and inwardly relative to the can body outer side wall when the closure and can body are in their normal relationships as, for example, prior to double seaming. The cover hook is curled such that the outermost extreme edge of the cover hook has a smaller radius of curvature than the middle of the cover hook. Thus, the extreme edge of the cover hook is folded inwardly toward the center of the closure which causes the closure to be doubled back to some degree upon itself. This makes the process of forming the end closure in a single operation impossible.

In the past, techniques for producing round and nonround end closures having the required cover hook had been disclosed, see for example, U.S. patent to Douglas U.S. Pat. No. 1,890,936, which discloses an apparatus and a method for forming the complete end closure in two steps in different dies. The first step preforms the end such that the extreme edge of the cover hook extends generally downward but not inward (relative to its position in a container open upwardly). The second operation in a second die forms the cover hook extremity inwardly thus, the complete end closure is formed in two operations in two different dies. The problem with this technique is that in a high-speed operation it becomes very difficult to transfer the preformed end into the second die for final forming. That is to say that, in order to handle the preformed end same must be lifted out of the first die and transferred laterally to a second die whereat centering and depositing of the end in that die has to occur. In a process taking place at several hundred per minute the mechanism for carrying transversely and precisely positioning the preformed end into the final forming die is a problem. This is even a greater problem in connection with nonround ends wherein mere centering is not enough. Register with respect to the corners must be perfect in order to avoid jamming and misforming.

Attempts at overcoming this handling problem have been tried. One technique uses the concept of leaving a portion of the first die for preforming open or making same openable whereby the end can be slid laterally sideward from that die to the second die for final forming. Similarly, the second die also includes an open side or moveable die section designed to receive the sliding and preformed end closure. Such an arrangement is difficult and complicated to make and presents problems with respect to uniformly and completely forming a continuously made cover hook adequate for providing a proper hermetic double seam.

Another prior art approach for making an end closure with a curved cover hook included a first operation which formed the end and the second operation of roll forming to curl the edge. In order to keep up with the high speed of the preforming operation a number of curlers are required to tip the edge inward.

OBJECTS OF THE INVENTION

It is the object of the present invention to provide a single die which is capable of forming round or nonround ends complete with a usable cover hook adequate for hermetic double seaming.

It is a further object of this invention to provide a method of forming a round or nonround end with the requisite configuration including a countersink groove and wall leading to a double seam cover hook which is capable of cooperating with an open end of a container body flanged to receive same.

It is a further object of this invention to provide a simple, reliable, low cost die and operational method for using same which will permit the high-speed forming of end closures in a single apparatus adapted to perform a multistep operation.

SUMMARY OF THE INVENTION

With the foregoing objects in mind and the difficulty of the prior art, the improvement herein is the apparatus and method for using same which includes a die tool for forming an end including a cover hook curl in a one station multistep operation at speeds of 350 strokes per minute. In the die tool flat metallic sheet stock is positioned between a punch holder and die holder while same are in their open and spaced apart position. As the tools close the metallic stock is first clamped between a resiliently biased pressure pad and the blanking punch. A blanking punch then trims the metallic stock to the blank configuration having a predetermined cut edge and while the blanked metallic stock is still clamped the bottom of the die moves up drawing the blank between a draw punch and forming the draw against the rising inside diameter of the blanking punch. Then the end countersink groove is formed by a concentrically disposed countersink inner punch which rises with the blanking punch and presses the center of the end closure against an upper inside center panel die which forms same relative to the countersink punch. The material held between the blanking punch and the draw punch is fed inwardly under the influence of forming of the countersink punch and the center panel die such that only a short portion of the extreme part near the cut edge remains clamped between the draw punch and the blanking punch. More specifically, near the end of the stroke of the die the extreme portion rests in a die curling radius on the blanking punch and is positioned there so that the final travel of the die presses the cover hook inwardly after withdrawing the draw punch. Thus, the portion of the cover hook between the wall of the countersink and the cover hook extremity is bent to a position more normal to the axis of the cover so the extremity of the cover hook is at a final configuration which includes the inwardly tip of the cover hook extremity. A stripper is then able to use the last upward die movement to release the formed end.

A die arrangement similar to that used for round ends forms the nonround ends with its inwardly tipped curl on the cover hook. Nonround ends do not include a countersink groove but are formed merely with a depressed central panel. Therefore, the tooling for nonround ends is simplified. In a manner well known, the sheet material is first blanked and then drawn into a shallow cup shape between a draw punch and a blanking punch and draw die. Located concentrically within the blanking punch and draw die is a center panel punch which is resiliently carried by the top die shoe so that it can move relative to the blanking punch and draw die which are resiliently affixed to the same die shoe. Upon upward movement of the draw punch the shallow cup is preliminarily formed against the blanking punch and carried onto contact with the center panel punch thus bending the center of the cup downwardly while drawing the end of the wall of the cup across the nose of the draw punch to form a hook continued upward movement of the draw punch carries with it a center panel die which catches the formed sheet between its inside wall and the outside diameter of the center panel punch thus bending and further drawing the circumferential periphery of the preformed sheet to create the wall of the interior recessed panel, the flange of the cover hook and the final hook shape on the peripheral extremity of the sheet. The last upward movement of the lower die shoe causes the center panel die to move upwardly relative to the draw punch bending the sheet stock at the flange of the cover hook so that same is normal to the axis of the tooling by pressing the flange against a horizontal face of the blanking punch and draw die. This final bend causes the tip of the cover hook to be bent inwardly but same does not interfere with the draw punch which is now clear of the sheet stock. Because there is no countersink groove the formed nonround end can be easily stripped by an air blast and so there is no need for a stripper.

BRIEF DESCRIPTION OF THE DRAWINGS

FIG. 6 shows an alternate embodiment preferably of tooling used for making nonround ends wherein the countersink groove is not required but a recessed center panel is. In FIG. 6, the stock is shown immediately after blanking but prior to any significant forming. It will be noted that the tooling is reversed from that shown in the earlier figures in that here the end is made with the cover hook down.

FIG. 7, the same tooling shown as in FIG. 6, is depicted with a further step in the operation of preforming the end and here the center panel punch has begun to form the stock into a center panel die by drawing same across the draw punch leaving the extremity of the blank primarily curled over the nose of the draw punch.

FIG. 8 shows a further movement of the center panel punch in the tool of FIGS. 6 and 7 which draws still further the stock across the draw punch leaving the extremity of the partially formed end curled over the nose of the draw punch, and FIG. 9 shows the final step in the operation of the tool of FIGS. 6, 7 and 8 wherein the outer annular portion of the center panel die pushes the cover hook away from the draw punch and to a more normal position relative to the axis of the end closure such that the curl on the end of the cover hook is tipped inwardly.

DETAILED DESCRIPTION OF THE DRAWINGS

Figure 1:
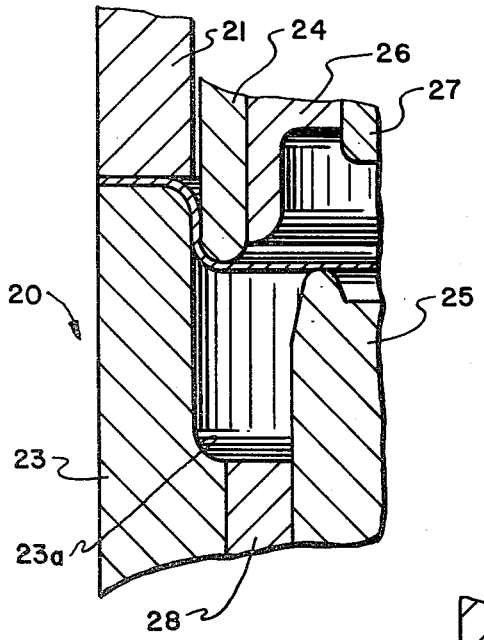
FIG. 1 is a partial cross-sectional view of one portion of the die showing the position of the various components used in forming a round end closure at the start of the operation just after the sheet stock is blanked and slightly cupped.

In FIG. 1, a portion of a tool for forming round ends is shown, and the tool consists of a die set 20 with upper and lower concentric portions which cooperate to move coaxially along the axis of the tool with respect to one another. During the movement of the various tool portions the steps of the method of forming of an end take place. In the preferred embodiment shown in FIGS. 1 through 5, a circular end for a beverage container is produced. As shown captured within the die 20 in FIG. 5, the end includes countersink groove 11, a center panel 12, a countersink wall 13, a cover hook flange 14 and a cover hook curl 15 ending in an inwardly tipped extremity 16. This is a standard configuration for a circular beverage container end. To arrive at this configuration, the material is fed into the open die 20 (not shown) wherein the bottom and top portions are spaced apart and the material is a flat metallic sheet which is blanked to a cut edge diameter necessary to produce the finished end configuration shown in FIG. 5.

FIG. 1 shows the sheet blanked and partially drawn. More particularly, the die set 20 includes a resiliently biased pressure pad 21 which is in vertical alignment with a blanking punch 23. These components along their left edge have a shearing means (not shown), for cutting the blank. What is shown in FIG. 1 is the already blanked stock being held between pressure pad 21 and by blank punch 23. A drawing punch 24 extending from above begins to stretch and pull the blanked sheet against the radius upper inside diameter of the blanking punch 23 as same is moved upwardly. More particularly, the draw punch or first tool means 24 comes against the stock and captures same between it and the upper inside radius corner of the blanking punch 23.

During this process the pressure pad 21 evenly retards the feed of metal so as to prevent wrinkling. Thus, the center panel of the sheet stock is formed into a downward recessed portion as shown in FIG. 1.

Figure 2:
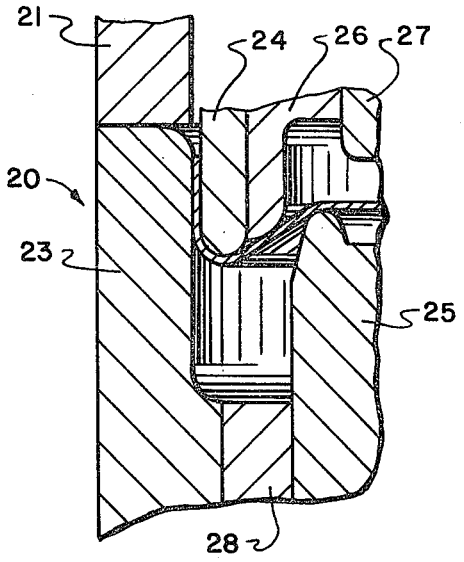
FIG. 2 shows the same die portion as in FIG. 1, however, the forming operation has proceeded further in that the countersink punch has moved upwardly with the bottom of the tool to begin to form the countersink.

FIG. 2 shows the next step in the formation of the round end closure. Here a countersink punch 25 or second tool means which is centrally disposed and coaxially located to be inside of the draw punch 24 begins to move upwardly against the bottom center recessed portion of the panel of the sheet as formed in FIG. 1 causing same to bend upwardly in the central portion by drawing and pulling the metal across the rounded lower end of the draw punch 24. Disposed immediately inside the draw punch 24 and resiliently mounted for movement relative thereto is an inside upper die or third tool means 26, see FIGS. 1 and 2; draw punch 24 and inside upper die 26 stay together during this step of the forming operation. Thus, the sheet as formed in FIG. 2 by the movement of the countersink punch 25 (upward) which pulls to preform the end across the downwardly extending lower nose of draw punch 24 and the rounded lower face of upper inside die 26.

Figure 3:
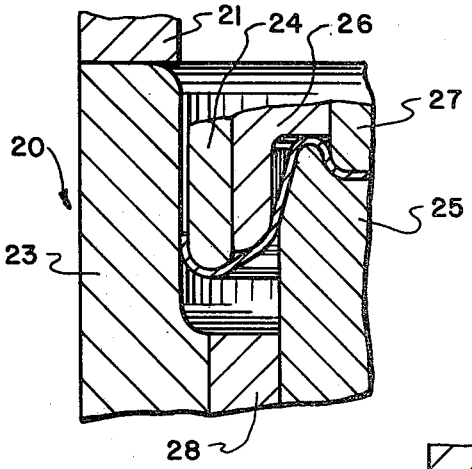
FIG. 3 is a further step in the operation of the same die as seen in FIGS. 1 and 2 wherein the countersink is completely formed, the metal being drawn inwardly from the original cut edge to form at the extreme edge the first semblance of a cover hook.

FIG. 3 shows the next step in forming the end which includes further upward movement of the countersink punch 25 relative to the nose of punch 24 and the face of inside upper die 26. In moving upwardly, the countersink punch 25 caused the formed sheet to be drawn still further and the center panel thereof to engage an upper holding punch 27 which is centrally disposed and aligned to cooperate with a recess in the center face of the countersink punch 25. Thus, inside wall of a countersink groove is formed by the cooperation of the countersink punch 25 and the upper holding punch 27 and the outside countersink wall 13 of the countersink groove is formed by the downward extension, of draw punch 24 and upper inside die 26 which draw the sheet against the sides of the countersink punch 25. The extremity of the cover hook now begins to emerge along the periphery of the formed sheet but must be further formed in order to develop into its final inwardly tipped more tightly curled configuration.

Figure 4:
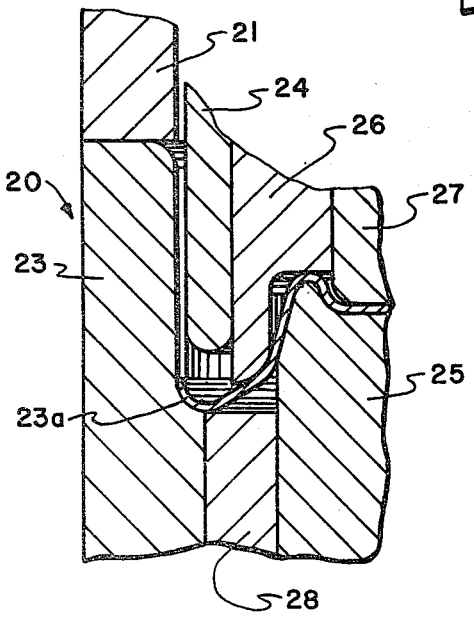
FIG. 4 is a step further in the rise of the bottom of the tool shown in FIGS. 1, 2 and 3 and in particular, the further forming of the cover hook by the upper inside die which causes the cover hook to seat in a die curl radius of the blanking punch.

FIG. 4 shows the next step in the operation of the die set 20. More particularly, the upper inside die 26 extends downwardly relative to the draw punch 24 which is lifted by further movement of the blanking punch 23 by means of a lost motion connection therebetween which is not shown. The partially formed sheet is caused to be pressed against lower reaches of the outer side wall of the countersink punch 25 by the extension of the upper inside die 26 which remains extended. The blanking punch 23 has moved upwardly causing the extremity of the cover hook to fall into a portion of the blanking punch 23 located at the bottom of the inside wall thereof called the die curl radius or fourth tool means **23*a* whereby the force imparted by the upper inside die 26** causes the extremity of the cover hook to be formed against the die curl radius and bent upward so that its extreme end tips inwardly toward the center of the end.

Figure 5:
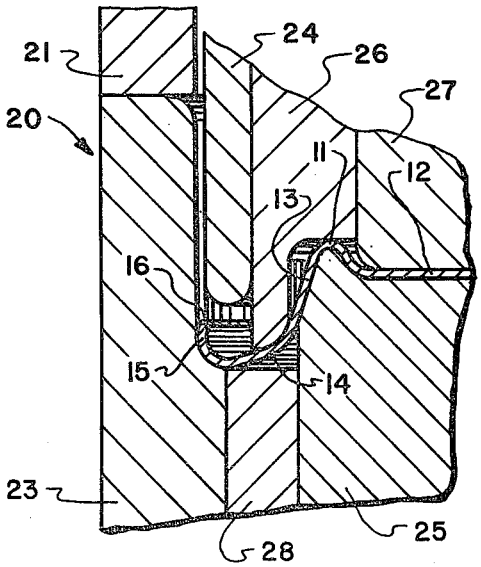
FIG. 5 shows the last step in the formation of a round end closure wherein a stripper is used to push the end closure out of the die while also the forming of the cover hook and curl to its final configuration by bending same relative to the upper inside die into a more normal position relative to the axis of the end.

In FIG. 5, the furthest progression and formation between upper inside die 26 and the die curling radius **23*a* is shown with the end having its final configuration. That is to say that, the lower face of the upper inside die 26 bares upon the portion of the end closure between the countersink wall 13 and the flange of the cover hook 14 bending same to form the cover hook flange against a die stripper 28 located immediately therebeneath and captured coaxially between the blanking punch 23 inner diameter and the countersink punch 25** outer diameter as the blanking punch completes its rise.

A stripper 28 is located to push against the cover hook flange 14 causing the end to part from the die with a final configuration wherein the end cover hook flange is more nearly normal to the axis of the end. Thus, an end with a cover hook curled inwardly is produced in a single die in a manner which permits the completed end to be removed without collapse of any portion of the die or without a complicated or slow moving tooling.

In FIGS. 6, 7, 8 and 9 a tool die set 30 that is similar to die set 20 is shown in various states of movement during its progression for forming a nonround end. The tooling is contained between upper and lower die shoes in a press (conventional and, therefore, not shown), but is coaxially aligned for cooperative movement, as will be explained in detail. A sheet of flat stock is positioned between open portions of the upper and lower die tooling and the sheet is blanked and drawn into a completed cup shape as shown in FIG. 6. The blanking and initial forming are conventional and are, therefore, not included in the figures.

In FIG. 6, a draw punch or first tool means 31 carried resiliently on the lower die shoe of the press captures the sheet and draws it against an inside diameter of a blanking punch and draw die 33 which is carried by the upper die shoe of the press. In coaxial alignment along the same axis and disposed within the blanking punch and draw die 33 is a center panel punch or second tool means 32 resiliently mounted to the upper die shoe for movement relative thereto and relative to the blanking and draw die 33. There is a space between the forming portions of the blanking punch and draw die 33 and the center panel punch 32. The radial distances of this space establishes the cover hook flange dimension and shape. More particularly, as shown in FIG. 9, the formed end has a configuration which in certain aspects is similar to that disclosed in connection with the round end shown in FIG. 5, and, consequently identical numbering will be used in order to simplify the understanding and to identify the similar parts of the nonround end in this embodiment. More particularly, in FIG. 9 there is a cover hook flange 14 terminating in a peripheral cover hook 15 with an inwardly tipped end 16. Again, the center panel is labelled 12 but the wall between the cover hook flange and the center panel is now labelled **13*a*** because it is similar to the outer wall of the countersink but it is not a countersink wall.

In FIG. 7, the further upward movement of the draw punch 31 is shown and same moves with a center panel die or third tool means 34 as it is spring loaded against 34. More particularly, as shown in FIG. 8, there is an abutting face **31*a* which cooperates with a moving face 34*a* on draw punch 31 and center panel die 34 respectively. The positioned relationship between the draw punch 31 and the center panel die 34 in FIGS. 6, 7 and 8 are identical and as the panel punch 34 moves upwardly draw punch 31 follows it due to spring loading until initial contact is made between draw die face 33*a* and draw punch face 31*b*, see FIG. 8. After contact the combination of the draw punch 31 and the center panel die 34 proceed as shown in FIG. 9, and further upward movement meets against the resilient downward loading of the center panel punch 32. That is to say that, further upward movement of the panel punch 34 proceeds without further movement of punch 31 and in a like manner the blanking punch and draw die 33 holds draw punch 31 by means of contact between face 31*b* on the draw punch and face 33***a* on the blanking punch and draw die. The upward movement causes the preformed sheet stock to be formed between the inside of the center panel die 34 and the outside of the center panel punch 32 whereby the cover hook flange is formed by first drawing the sheet across the upper nose of the draw punch 31 to form its end into a hook as shown in FIGS. 7 and 8. The sheet is also bent during drawing between the center panel die 34 and the center panel punch 32 thus forming the cover hook flange within the flange space between the blanking punch and drawing die 33 and the center panel die 32.

FIG. 9 shows the final forming of the nonround end which takes place as a result of last upward movement by the center panel die 34 relative to the draw punch 31. This movement is a result of the last movement of the lower die shoe to the complete limit of its travel. That is to say that, the blanking punch and draw die 33 is the limit stop whereby the draw punch 31 can move no further even though the lower die shoe is still traveling upwardly since faces 31*b* and 33*a* abut one another. Further upward movement of the lower die shoe causes the center panel die 34 to move independently of the draw punch 31 causing the cover hook flange 14 to be bent perpendicular relative to the wall 13*a* disposed between it and the center panel 12. The final movement of the center panel die 34 moves the center panel punch 32 upwardly against its resilient loading so that the formation of the recessed central panel 12 in the final configuration of the nonround end is as prescribed by the shape of the mating portions of the center panel die 34 and the center panel punch 32. Similarly, the cover hook flange is formed with a dimension equal to the flange space between the blanking punch and draw die 33 and the center panel punch 32. The final bend applied to the end changes the cover hook as formed across the nose of the draw punch 31 so that same is now tipped inwardly. It will be noted that the inwardly tipping of the cover hook 15 takes place after the cover hook flange is moved upward and clear of the nose of the draw punch 31.

It will also be noted that the blanking punch and draw die 33 includes a curling radius or fourth tool means 33*b* which is disposed to receive the cover hook as same is bent during final forming, see FIGS. 8 and 9. Stripping is easily accomplished by an air jet or the like since the formed end is not locked into the die set 30.

While tooling for round and nonround ends have been shown and while both ends have slightly different configurations, the invention in its broadest context and aspects seeks to protect all techniques including tooling apparatus and methods for using same which form end closures being preformed by shaping of flat stock across a shaped forming tool to develop an initial hook shaped periphery and then subsequently in the same tool reforming to tip the hook inward. The preferred equipment and technique apply a combination of pulling, stretching and drawing between mating punch and die components for forming of the hook or curl. The cover hook flange is formed and bent to its final configuration by tooling disposed within the primary curl or hook forming tooling. Such secondary tooling operates relative to but independently from the primary tooling in the same die set in a final operation to form and bend a cover hook flange which in the process carries the already preliminarily formed hook or curl into a curling die radius wherein the curl is bent independently of the primary tooling so that there is an inwardly tipped periphery. Being clear of the primary tooling, the completed end can be removed. It is, therefore, desired that all tooling arrangements in a single die set which form completely an end with an inwardly tipped curl or hook are to be covered by the claims which follow.

What is claimed is:

1. An apparatus for making a thin sheet of stock into a container end closure having a peripheral cover hook curl the extremity of which is inwardly tipped, said apparatus being carried in a press and having forming means carried for cooperative movement with each other and a blanked portion of said stock as at least one of said forming means is moved toward the other and wherein said forming means having at least four tool means including:

a first tool means with a shaped curved face configured like the inside cross-sectional contour of a cover hook curl, a second tool means disposed within said first tool means and adapted for movement in one direction toward said first tool means against said blank to form the center thereof and pull the periphery of said blank over said first tool means developing a cover hook curl configuration thereacross, a third tool means disposed between said first and second tool means and adapted to be independently positioned relative to said first and second tool means and with respect thereto for reforming said cover hook, and a fourth tool means positioned about said first tool means and having an internal die curling radius with the external contour and peripheral shape of said cover hook curl for receiving same and for guiding the extreme edge of the cover hook curl inwardly toward the center of the end during reforming said end closure.

2. The apparatus of claim 1 wherein said second tool means includes punch and die sections which cooperatively interengage to draw the blank center forming same by gathering material inwardly from the periphery.

3. The apparatus of claim 2 wherein said second tool means includes portions shaped to form a countersink groove against said third tool means said groove being the boundary of the formed center.

4. The apparatus of claim 3 wherein said tool means are circular and concentrically positioned within and about one another for forming a circular end closure.

5. The apparatus of claim 2 wherein said third tool means is carried on the peripheral portion of part of said second means.

6. The apparatus of claim 5 wherein said third tool means and said first tool means have interengaging portions which move together.

7. The apparatus of claim 6 wherein the travel for the first tool means is limited for restraining same and permitting independent and further movement of said further tool means.

8. A process for forming an end closure from a thin sheet of stock said end closure having a peripheral cover hook curl the extremity of which has been inwardly tipped by a tool wherein the stock is held in the same axially centered position relative to the tool during the entire forming process including the following steps:

centering a thin sheet of stock between opposed spaced apart tools, blanking and drawing said stock into a shallow cup held between said tools, forming the central portion of said cup by reverse drawing into the bottom of said cup a shallow recess while the peripheral portion thereof is pulled inwardly toward the center thereof carrying said peripheral portion across a curved forming tool to develop a cover hook curl at said peripheral portion, moving said end closure along its axis to displace same from said curved forming tool, and reforming the inwardly area of said peripheral portion to bend the extremity of said cover hook curl inwardly toward the center of said end closure.

* * * * *